United States Patent [19]

Nishikawa et al.

[11] Patent Number: 4,959,289

[45] Date of Patent: Sep. 25, 1990

[54] ELECTROPHOTOGRAPHIC ELEMENT HAVING A SURFACE LAYER AND METHOD FOR PRODUCING SAME

[75] Inventors: Masayuki Nishikawa; Shigeru Yagi, both of Kanagawa, Japan

[73] Assignee: Fuji Xerox Co., Ltd., Tokyo, Japan

[21] Appl. No.: 292,984

[22] Filed: Jan. 3, 1989

[30] Foreign Application Priority Data

Jan. 8, 1988 [JP] Japan ..... 63-1359

[51] Int. Cl.[5] ..... G03G 5/082

[52] U.S. Cl. ..... 430/64; 430/66; 430/95

[58] Field of Search ..... 430/66, 67, 95

[56] References Cited

U.S. PATENT DOCUMENTS 4,775,606 10/1988 Shirai ..... 430/67
4,795,691 1/1989 Takei et al. ..... 430/67

FOREIGN PATENT DOCUMENTS 58-162975 9/1983 Japan .
58-171038 10/1983 Japan .
61-29851 2/1986 Japan .

*Primary Examiner*—John L. Goodrow
*Attorney, Agent, or Firm*—Finnegan, Henderson, Farabow, Garrett, and Dunner

[57] ABSTRACT

An electrophotographic element has a surface layer with a ratio of the number of nitrogen atoms to silicon atoms of 0.5 or more, and a reflection factor is the surface layer for coherent light beams of 0.1 or less. Use of such an element prevents excessive light reflection at the surface layer, thereby preventing reflected light beams from forming interference fringes in a printed image. In this respect, the electrophotographic element according to the present invention is suitable for use as a photosensitive element in a laser printer utilizing a semiconductor laser beam as its light source.

7 Claims, 1 Drawing Sheet

ELECTROPHOTOGRAPHIC ELEMENT HAVING A SURFACE LAYER AND METHOD FOR PRODUCING SAME

BACKGROUND OF THE INVENTION

1. Field of the Invention

This invention relates to an electrophotographic element for use in a laser printer.

2. Description of the Related Art

Various types of electrophotographic elements have been developed, each having a photosensitive layer comprised of amorphous silicon deposited on a support member. An electrophotographic element having such an amorphous silicon photosensitive layer has many advantages, including high mechanical strength, color versatility, and long wavelength sensitivity. Developments in this type of electrophotographic element have been aimed at improving the electrophotographic characteristics of these elements. One proposal has considered the use of a photosensitive layer consisting of two sub-layers, a charge generating sub-layer and a charge transfer sub-layer. Another proposal includes providing an additional surface layer, comprised of amorphous silicon nitride.

Electrophotographic elements of the type discussed above are essential components in laser printer devices. However, prior art electrophotographic elements have caused interference fringes in laser printed copies. The printer's light source, a semiconductor laser, emits laser beams with wavelengths in the 780 to 830 nm range. When the laser printer is operated for printing, a laser beam reflected from the photographic element surface layer is superimposed on a beam reflected from the interior of the photosensitive layer or from the substrate, so that the two reflected beams interfere with each other. These reflected beams are alternately enforced and attenuated depending upon the thickness change of photosensitive layer, so that the amount of absorption in the photosensitive layer changes. The absorption change results in a potential change to the surface of the photosensitive layer. The potential change ultimately results in interference fringes in the copied image.

Various proposals have been made to address the interface problem associated with laser beam light. KOKAI Nos. 58-171038 and 61-29851 disclose proposals which attempt to reduce the reflection of beams from the substrate. KOKAI No. 61-29851 proposes a technique to reduce the reflection of beams from the surface layer. KOKAI No. 58-171038 proposes a light absorption layer containing germanium (Ge), which is formed on the substrate of the electrophotographic element. The absorption layer is provided to reduce the reflection of beams from the substrate. KOKAI No. 58-162975 uses a substrate with a coarsened surface in order to scatter the laser beams applied thereto. The technique disclosed in KOKAI No. 61-29851 employs a surface layer which has no reflection peak in the range of the wavelength of the light source ±50 nm. None of the above references however, have adequately solved the stated problem of interference fringes.

SUMMARY OF THE INVENTION

In order to overcome the above problems, an object of the present invention is to provide an electrophotographic element having a surface layer made of amorphous silicon nitride, which can adequately suppress the interference fringes caused by the reflection of laser light beams.

To achieve the foregoing object, an electrophotographic element having, for example, a support member serving as a substrate, a photosensitive layer deposited on the substrate comprised of amorphous silicon, and a surface layer deposited on the photosensitive layer comprised of amorphous silicon doped with nitrogen atoms is provided. The teaching of the present invention is that a ratio of the number of nitrogen atoms to that of silicon atoms in the surface layer of 0.5 or more, will result in a surface reflection factor of the surface layer for irradiated light of 0.1 or less. Consequently, the reflection of laser light is eliminated and the interference fringes are prevented.

Further, a method for forming an electrophotographic element of the present invention is provided.

BRIEF DESCRIPTION OF THE DRAWINGS

The accompanying drawings, which are incorporated in and constitute a part of the specification, illustrate a preferred embodiment of the invention, and together with a general description given above and the detailed description of the preferred embodiment given below, serve to explain the principles of the invention.

DETAILED DESCRIPTION OF THE PREFERRED EMBODIMENT

Figure 1:
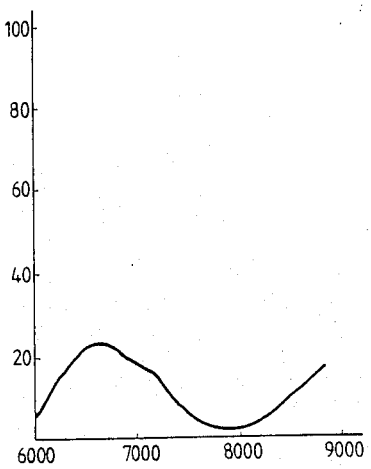
FIG. 1 is a graph comparing surface reflection factor vs. wavelength of the irradiated light of an electrophotographic element incorporating the teaching of the present invention.

An elecrophotographic element according to the present invention may use either a conductive support member or an insulative support member. The conductive support member may be made of a metal such as stainless steel or aluminum, or an alloy. The insulative support member may be a film or sheet made of polyester, polyethylene, polycarbonate, polystyrene, polyamide, or glass, ceramic or paper. Further, if the insulative supporting member is used, it is necessary to make the surface of the support member which is in contact with another layer electrically conductive.

A photosensitive layer deposited on the support member may include amorphous silicon doped with boron and/or another impurity. The photosensitive layer is formed by a glow discharge decomposition process. The process is performed by placing a support member in a plasma CVD apparatus or reactor, and introducing a raw gas into the reactor. The raw gas may be, for example, silane or silane derivative ($Si_2H_6$) gas. It may also contain diborane and/or another gaseous impurity. Silane or silane derivatives include, for example, $SiH_4$, $Si_2H_6$, $SiCl_4$, $SiHCl_3$, $SiH_2Cl_2$, $Si(CH_3)_4$, $Si_3H_8$, $Si_4H_{10}$, and the like. Alternatively, hydrogen gas, together with silane gas may be introduced into the reactor.

Other conditions for forming the photosensitive layer, when an alternating current is applied to the reactor are as follows: frequency at 50Hz to 5GHz, pressure in the reactor at $10^{-4}$ to 5 Torr, discharge power at 10 to 2000W, and temperature of the support member at 30 to 300° C.

The thickness of the resultant photosensitive layer may be between 0.1 to 100μm.

Next, a surface layer is deposited on, the photosensitive layer, comprising amorphous silicon doped with nitrogen, in which a ratio of the number of nitrogen atoms to that of silicon atoms is 0.5 or more.

The surface layer is formed in a manner similar to that of the photosensitive layer. Raw gas is introduced into a plasma CVD reactor, and the glow discharge decomposition process is used to deposit the surface layer. The raw gas used may be a mixture of silane gas and ammonia gas. A ratio of the flow rates of the ammonia gas to the silane gas is controlled so that the resultant atom-number ratio of nitrogen to silicon in the surface layer is 0.5 or more.

Other conditions for forming the surface layer when an alternating current is applied to the reactor are as follows: frequency 50Hz to 5GHz, pressure in the reactor $10^{-4}$ to 5 Torr, discharge power 10 to 2000W, and temperature of the support member 30 to 300° C.

As noted above, in accordance with the preferred embodiment of the invention, the surface layer of the electrophotographic member must be such that the ratio of the number of nitrogen atoms to that of silicon atoms is at least 0.5. If the ratio is less than 0.5, it is impossible to set a surface reflection factor of the surface layer for the semiconductor laser beam applied thereto at 0.1 or less. If the surface reflection factor exceeds 0.1, the laser beams with wavelengths of 780 to 830nm will reflect and interfere with each other, thereby resulting in the interference fringes associated with the prior art.

An electrophotographic element according to the present invention may additionally use a charge injection blocking layer, which is formed over the support member. The charge injection blocking layer is preferably made of amorphous silicon containing boron of 50 to 500ppm, and is preferably 2 to 55μm thick.

For a better understanding of this invention, three examples of electrophotographic element formation and use in a laser printer will be described. Example 1 will describe the preferred embodiment of the present invention. Examples 2 and 3 will be discussed for comparative purposes.

Example 1

A capacity coupled type plasma CVD reactor is used to form an amorphous silicon film over an aluminum tubular support member. In the reactor, a mixture of silane ($SiH_4$) gas and diborane ($B_2H_6$) gas is glow discharged. As a result of the glow discharge decomposition process, a charge injection blocking layer made of p-type amorphous silicon doped with boron (B) atoms, approximately 4μm thick, is formed over the tubular support member. The conditions for forming the charge injection blocking layer are:

| | |
|---|---|
| Flow rate of 100% silane gas | 150 $cm^3$/min |
| Flow rate of 100 ppm hydrogen-diluted diborane gas: | 150 $cm^3$/min |
| Pressure in reactor | 0.5 Torr |
| Discharge power | 200 W |
| Discharge time | 1 hr |
| Discharge frequency | 13.56 MHz |
| Support member temperature | 250° C. |

Following formation of the charge injection blocking layer, a mixture of silane and diborane gas is introduced into the reactor and is glow discharged to form a photosensitive layer. Through this decomposition process, an i-type amorphous silicon layer is deposited up to 16μm thick on the charge injection blocking layer. The conditions for forming the photosensitive layer are:

| | |
|---|---|
| Flow rate of 100% silane gas | 200 $cm^3$/min |
| Flow rate of 100 ppm hydrogen-diluted diborane gas | 20 $cm^3$/min |
| Pressure in reactor | 1 Torr |
| Discharge power | 200 W |
| Discharge time | 4 hr |
| Discharge frequency | 13.56 MHz |
| Support member temperature | 250° C. |

After the photosensitive layer is formed, the gas in the reactor is evacuated. A mixture gas of silane, hydrogen and ammonia is introduced into the reactor. Then, the mixture gas is glow discharged. As a result, a surface layer made of amorphous silicon containing nitrogen atoms, approximately 0.3μm thick, is formed over the photosensitive layer. The surface layer is formed under the following conditions:

| | |
|---|---|
| Flow rate of 100% silane gas | 24 $cm^3$/min |
| Flow rate of 100% hydrogen gas | 180 $cm^3$/min |
| Flow rate of 100% ammonia gas | 36 $cm^3$/min |
| Pressure in reactor | 0.5 Torr |
| Discharge power | 50 W |
| Discharge time | 1 hr |
| Discharge frequency | 13.56 MHz |
| Support member temperature | 250° C. |

The composition of the surface layer is analyzed. The analysis shows that a ratio of the number of nitrogen atoms to that of silicon atoms is approximately 0.7. The reflection spectrum of the electrophotographic member is measured. As shown in FIG. 1, a local minimum of reflection exists in the vicinity of wave-length 780nm. The surface reflection factor at the minimum point is 3%.

The electrophotographic element thus formed is assembled into a laser printer in which a semiconductor laser for generating a laser beam of wavelength 780nm is used for an exposure light source. An image printed out is evaluated. The result is a clear image suffering from no interference discrepancies.

Example 2

A charge injection blocking layer and a photosensitive layer are successively formed on a substrate. In this case, the reactor and the conditions and process for depositing these layers are substantially the same as those in Example 1. Subsequently, the reactor is completely evacuated. A glow discharge is performed in the reactor under the following conditions, to form a surface layer made of amorphous silicon containing nitrogen.

| | |
|---|---|
| Flow rate of 100% silane gas | 30 $cm^3$/min |
| Flow rate of 100% hydrogen gas | 180 $cm^3$/min |
| Flow rate of 100% ammonia gas | 30 $cm^3$/min |

-continued

| | |
|---|---|
| Pressure in reactor | 0.5 Torr |
| Discharge power | 50 W |
| Discharge time | 1 hr |
| Discharge frequency | 13.56 MHz |
| Support member temperature | 250° C. |

Figure 2:
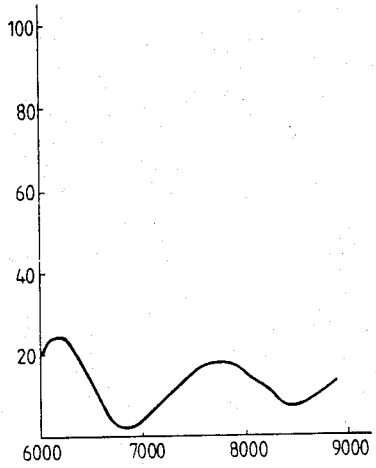
FIG. 2 is a graph comparing surface reflection factor vs. wavelength of the irradiated light of an electrophotographic element as formed by Example 2, and is presented for the purpose of comparison.

The composition of the surface layer formed is analyzed. The analysis result shows that a ratio of the number of nitrogen atoms to that of silicon atoms is approximately 0.6. The reflection spectrum of the electrophotographic element thus obtained is measured. The measurement result is plotted in FIG. 2, and shows that the reflection factor of the surface layer is 20% at a wavelength of 780nm.

The electrophotographic element thus formed is assembled into a laser printer using a semiconductor laser emitting a laser beam of 780nm wavelength for an exposure light source. An image printed out is evaluated. The result shows an image suffering from interference fringes.

Example 3

A charge injection blocking layer, a photosensitive layer, and a surface layer are successively deposited on a substrate. The reactor and the conditions and the process for depositing these layers are substantially the same as those in Example 1. Formation of the surface layer continues for only 55 minutes.

Figure 3:
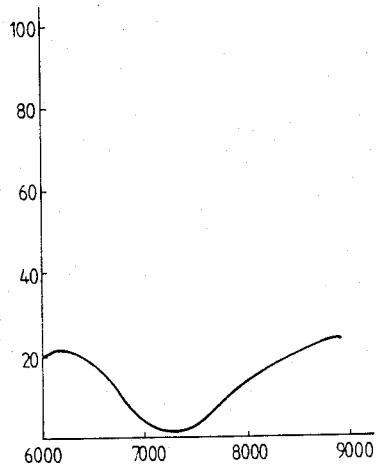
FIG. 3 is a graph comparing surface reflection factor vs. wavelength of the irradiated light of an electrophotographic element as formed by Example 3, and is presented for the purpose of comparison.

The reflection spectrum of the electrophotographic element thus obtained is measured. The measurement result is plotted in FIG. 3, and shows that the reflection factor of the surface layer is 11% at wavelength of 780nm.

The electrophotographic element thus formed is incorporated into a laser printer using a semiconductor laser capable of emitting a laser beam of wavelength 780nm for an exposure light source. An image printed out is evaluated. Slight interference fringes were observed in the obtained image.

The preferred embodiment of the present invention, as demonstrated in Example 1, successfully corrected the laser light reflection problem.

Additional advantages and modifications will be understood by one skilled in the art. The invention in its broader aspects is, therefore, not limited to the specific details and illustrative example shown and described. Accordingly, departures may be made from such details without departing from the spirit or scope of applicants general inventive concept.

What is claimed is:

1. An electrophotographic element comprising:

a support member serving as a substrate;

a photosensitive layer deposited on said support member through a glow discharge decomposition process and including amorphous silicon doped with an impurity, said impurity including boron;

a surface layer having a reflectance factor of 0.1 or less for laser light in a wavelength range of 780 nm, said surface layer being deposited on said photosensitive layer through a glow discharge decomposition process, including amorphous silicon doped with nitrogen atoms, and having an atom-number ratio of nitrogen to silicon of 0.5 or greater.

2. An electrophotographic element according to claim 1, further comprising a charge injection blocking layer of amorphous silicon doped with boron atoms deposited on said support member.

3. An electrophotographic element according to claim 1 wherein said support member includes a conductive material.

4. An electrophotographic element according to claim 1, wherein said support member includes an insulating material made of one of polyester, polyethylene, polycarbonate, polystyrene, polyamide, glass, ceramic and paper.

5. An electrophotographic element according to claim 2 wherein said charge injection blocking layer includes P-type amorphous silicon doped with boron atoms.

6. A method for forming an electrophotographic element comprising the steps of:

placing a support element substrate in an evacuated capacity coupled type plasma CVD reactor;

injecting a first gaseous mixture of silane ($SiH_4$) and hydrogen-diluted diborane ($B_2H_6$) gas into said reactor and glow discharging said first gaseous mixture to deposit a photosensitive layer of amorphous silicon doped with an impurity on said substrate, said impurity including boron;

evacuating said reactor;

injecting a second gaseous mixture of silane, ammonia, and hydrogen gas into said reactor and glow discharging said second gaseous mixture to deposit a surface layer on said photosensitive layer, said surface layer having a reflectance factor of 0.1 or less for laser light in a wavelength range of 780 nm to 830 nm, and a ratio of nitrogen atoms to silicon atoms of 0.5 or more.

7. A method in accordance with claim 6 further comprising the step of injecting a mixture of silane and hydrogen-diluted diborane gas into said reactor and glow discharging said gas mixture to form an injection blocking layer on the substrate.

* * * * *